US005323138A

United States Patent [19]

Oki et al.

[11] Patent Number: 5,323,138

[45] Date of Patent: Jun. 21, 1994

[54] RELIABLE THIN FILM RESISTORS FOR INTEGRATED CIRCUIT APPLICATIONS

[75] Inventors: Aaron K. Oki, Torrance; Donald K. Umemoto, Manhattan Beach; Frank M. Yamada, Torrance; Dwight C. Streit, Long Beach, all of Calif.

[73] Assignee: TRW Inc., Redondo Beach, Calif.

[21] Appl. No.: 940,556

[22] Filed: Sep. 4, 1992

[51] Int. Cl.[5] ..... H01C 1/012

[52] U.S. Cl. ..... 338/307; 338/195; 338/309; 338/314

[58] Field of Search ..... 338/195, 309, 306, 307, 338/308, 314

[56] References Cited

U.S. PATENT DOCUMENTS

| | | | |
|---|---|---|---|
| 4,952,904 | 8/1990 | Johnson et al. | 338/306 X |
| 5,081,439 | 1/1992 | Natzle et al. | 338/195 |
| 5,111,179 | 5/1992 | Flassayer et al. | 338/307 X |

*Primary Examiner*—Marvin M. Lateef
*Attorney, Agent, or Firm*—Ronald L. Taylor

[57] ABSTRACT

A thin film resistor with an insulating layer disposed between a substrate material and a resistor material is disclosed. Also, disclosed is a technique for fabricating this thin film resistor. In accordance with the preferred embodiment, the thin film resistor employs an insulating layer of silicon nitride with a thickness of 2000 Å. The insulating layer prevents the resistor layer from diffusing into the substrate material which, in turn, significantly reduces variations in the resistor value during accelerated life testing. Compared to thin film resistors with a resistor layer evaporated directly upon a substrate material, reliability is increased from a few hundred hours up to thousands of hours. Also, the maximum current handling capability is increased by greater than one order of magnitude, which results in a thin film resistor which requires less surface area of a wafer.

20 Claims, 5 Drawing Sheets

| CASE | DESIGN CONDITIONS | | TFR | | REQUIRED TFR DIMENSIONS | | | |
|---|---|---|---|---|---|---|---|---|
| | R (Ω) | MAXIMUM CURRENT HANDLING CAPABILITY (mA) | RESISTIVITY (Ω/□) | DESIGN RULE (mA/μm WIDTH) | w (μm) | l (μm) | T (Å) | SURFACE AREA ($\mu m^2$) |
| 1 | 200 | 6.0 | 100 | 0.3 ($3 \times 10^6 A/cm^2$) | 20 | 40 | 100 | 800 |
| 2 | 200 | 6.0 | 100 | 0.02 ($2 \times 10^5 A/cm^2$) | 300 | 600 | 100 | $1.8 \times 10^5$ |

Fig-6

RELIABLE THIN FILM RESISTORS FOR INTEGRATED CIRCUIT APPLICATIONS

BACKGROUND OF THE INVENTION

1. Technical Field

This invention relates generally to thin film resistors, and more particularly to thin film resistors with improved reliability and higher current density capabilities 2. Discussion of The Related Art Thin film resistors are utilized in integrated circuits in many important commercial applications They are frequently used where the integrated circuits are exposed to high temperatures such as in machine rooms, in interiors of automobiles, and in many other areas. In addition, thin film resistors are useful in "space" and "flight" applications which require a high degree of reliability. An important benchmark for such applications is that the resistors maintain constant resistance values over widely varying temperatures.

Currently, thin film resistors are manufactured with a resistor material evaporated directly onto the top surface of a wafer substrate. Electrically conducting contacts are then formed on designated areas of the resistor material and the remaining surface area is covered with a passivation layer of material such as silicon nitride. Unfortunately a thin film resistor produced according to this prior technology is susceptible to sharp increases in resistance value within the first few hundred hours of operation because the resistor material diffuses into the wafer substrate. Such increases in resistance, can render integrated circuits requiring specific resistance values inoperative or cause them to operate at a wrong frequency. These problems with thin film resistors are exacerbated by increasing temperature and current density.

Thus, it would desirable to provide a thin film resistor which would maintain a relatively constant resistance value when subjected to large current densities and high temperatures for extended periods of time. Further, it would be desirable to provide a technique for producing a thin film resistor with in which the resistor material does not diffuse into the substrate of the integrated circuit on which it is employed.

SUMMARY OF THE INVENTION

Pursuant to the present invention, a thin film resistor is disclosed having an insulating layer disposed between a substrate material and a resistor layer with a passivation layer disposed on the top surface of the resistor layer. In addition, a technique for fabricating a thin film resistor with a resistor layer "sandwiched" between insulating and passivation layers is also taught. The insulating layer material which results in a device with minimal variations in resistance when under the stress of accelerated life testing. Also, this results in a thin film resistor having an increased maximum current density which permits a reduction in the size of the resistor. Moreover, this reduction in size reduces the cost of the device.

In accordance with the first aspect of the present invention, the thin film resistor is comprised of a substrate, an insulating layer formed on top of the substrate, a resistor layer formed on top of the insulating layer, and a set of contacts for making external electrical contact with the resistor layer. The insulating layer is disposed between the resistor layer and the substrate so as to prevent diffusion of the resistor layer material into the substrate which, in turn, prevents large increases in resistor values.

In accordance with a second embodiment of the present invention, a method is provided for producing a thin film resistor which includes the steps of providing a substrate wafer upon which an insulating layer is formed. Next, a resistor layer is formed on top of the insulating layer. Finally, contacts are attached to the resistor layer to complete the resistor.

BRIEF DESCRIPTION OF THE DRAWINGS

The various advantages of the present invention will become apparent to those skilled in the art after reading the following specifications and by reference to the drawings in which:

FIG. 6 is a table comparing the physical dimensions required for a specific maximum current handling capability for the thin film resistor in accordance with the present invention (Case 1) and for a thin film resistor in accordance with the prior art (Case 2).

DETAILED DESCRIPTION OF THE PREFERRED EMBODIMENT

The following description of the preferred embodiments is merely exemplary in nature and is in no way intended to limit the invention or its application or uses.

The present invention discloses a thin film resistor comprising a resistor layer "sandwiched" between an insulating layer and a passivation layer through which a set of contacts with the resistor layer are formed. Also disclosed, is the fabrication technique for producing thin film resistors with a resistor layer that is insulated from the top surface of the substrate. It will be appreciated that the "sandwich" structure prevents diffusion of the resistor layer into the top surface of the substrate which, in turn, produces a thin film resistor with high reliability when exposed to the stress of accelerated life testing. The "sandwich" structure allows the thin film resistors to be operated at maximum current densities that exceed Military Standard MIL-M-38510F limits by greater than one order of magnitude. As a result of a higher current density capability, a thin film resistor with the "sandwich" structure of the present invention requires less surface area of the wafer than a comparable prior technology thin film resistor.

Figure 1:
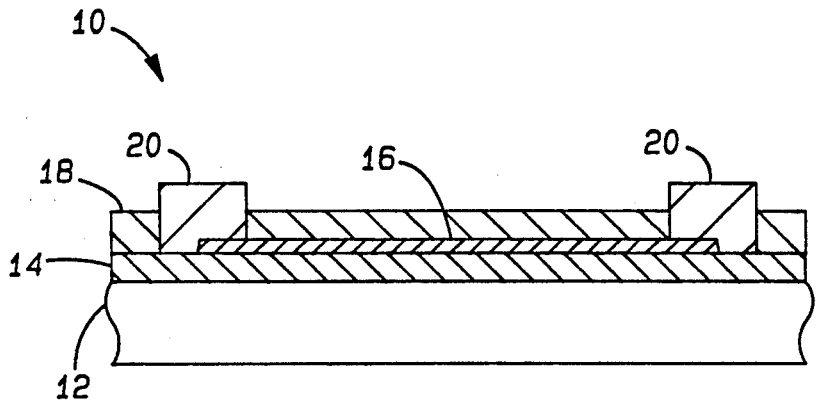
FIG. 1 is a representation of the cross sectional profile structure of the thin film resistor with the resistor layer "sandwiched" between the insulating layer and the passivation layer in accordance with the present invention.

First turning to FIG. 1, there is shown a cross sectional representation of a thin film resistor 10 having a "sandwich" structure in accordance with a preferred embodiment of the present invention. A semi-insulating GaAs (gallium arsenide) substrate wafer 12 is covered by an insulating layer 14 of SiN (silicon nitride). On insulating layer 14, is a resistor layer 16 which is composed of NiCr (nichrome), in a preferred embodiment. Other suitable materials NiCr are TaN (Tantalum Nitride) and Cermet which may also be used. Insulating layer 14 provides physical separation between resistor layer 16 and substrate wafer 12 such that diffusion of resistor layer 16 into substrate wafer 12 is prevented. On top of resistor layer 16, is a passivation layer 18 which is also composed of SiN (silicon nitride). Passivation layer 18 is used as a blocking layer to shield resistor layer 16 from the external environment. Finally, on top of designated areas of resistor layer 16 and insulating layer 14, are first interconnect metal contacts (FIC) 20 which do not physically come into contact with substrate wafer 12. It should be noted that GaAs, SiN, and NiCr are used by way of example, and other combinations of materials are within the scope of the present invention. Also substrate 12 may be part of the substrate of a larger integrated circuit which contains other electronic components that are connected to the thin film resistor 10 by means of the metal contacts 20.

Figure 2:
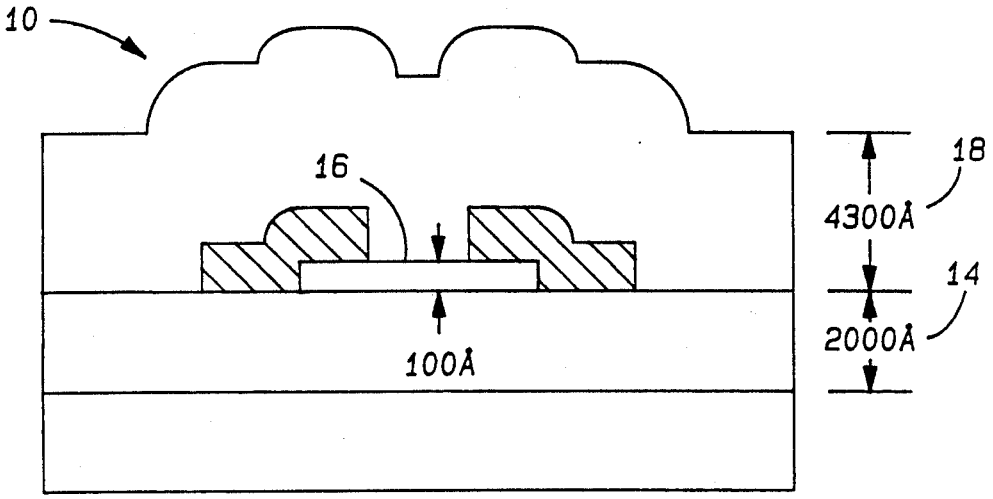
FIG. 2 is a representation of the thicknesses of the various layers of the thin film resistor as fabricated in accordance with the present invention.
Figure 3A:
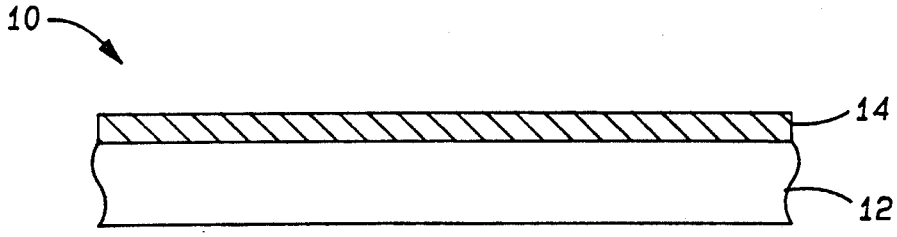
FIGS. 3-A-3-I shows the various steps used to fabricate the thin film resistor with the insulating layer of FIG. 1.
Figure 3B:
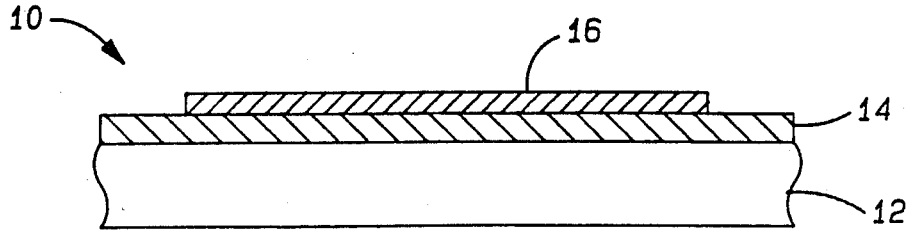
Figure 3C:
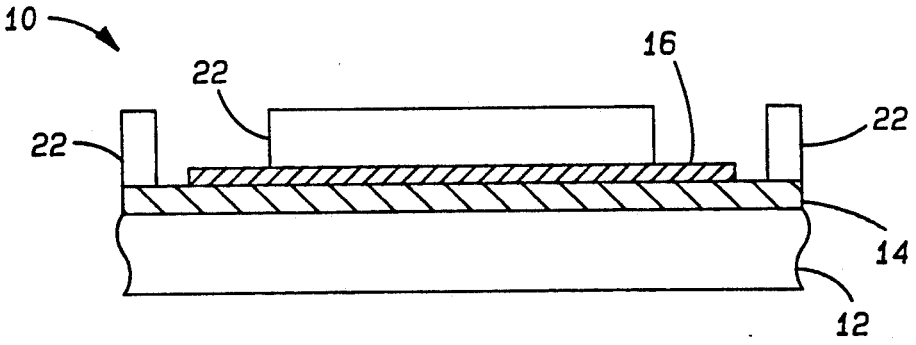
Figure 3D:
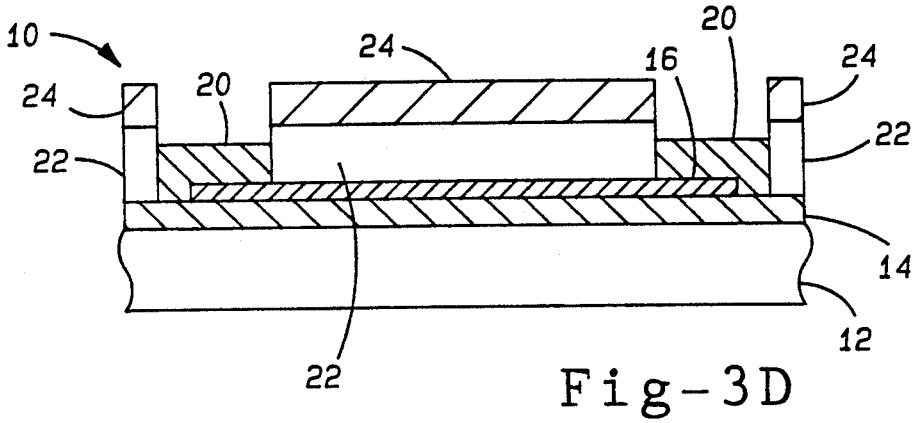
Figure 3E:
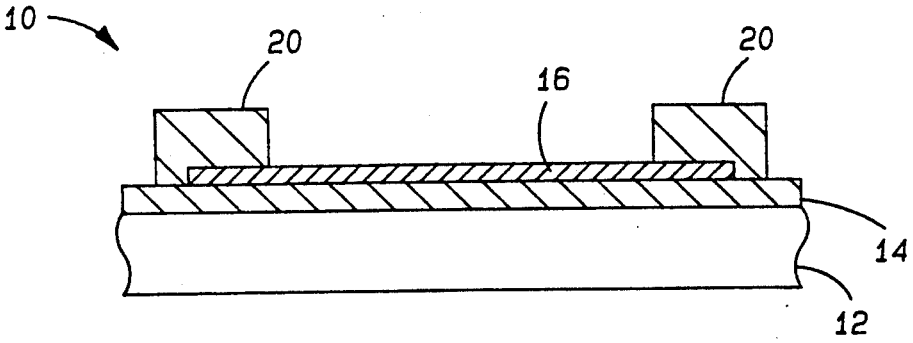
Figure 3F:
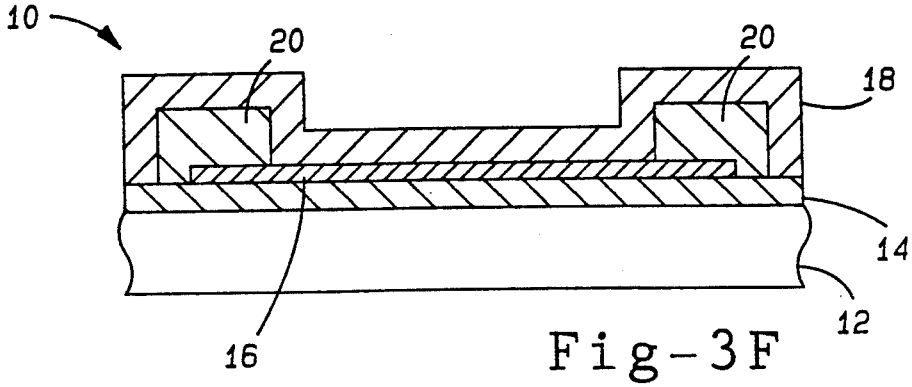
Figure 3G:
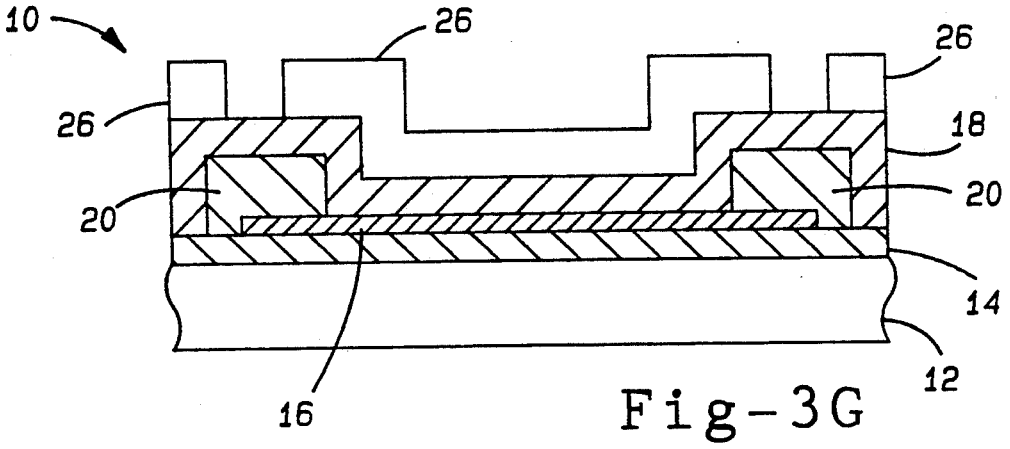
Figure 3H:
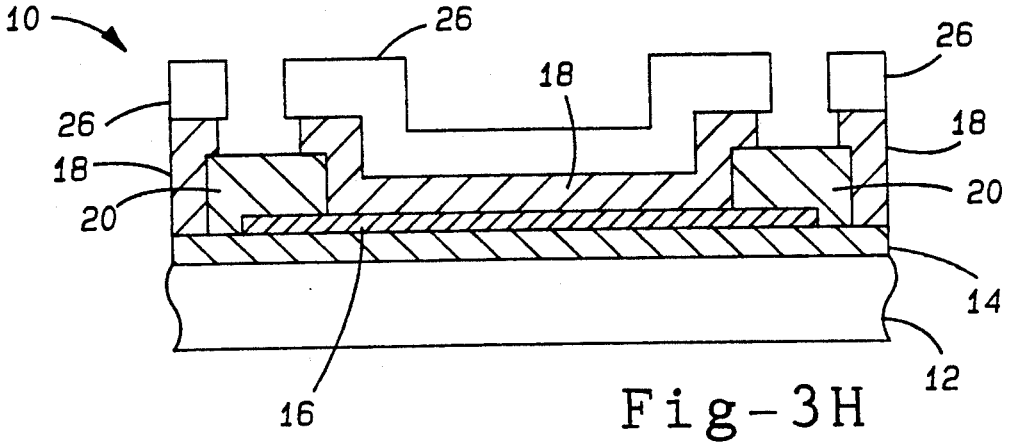
Figure 3I:
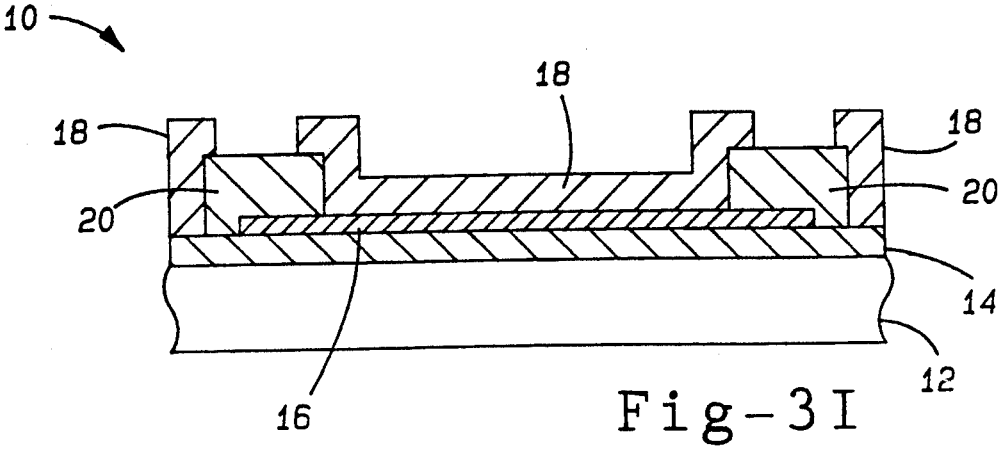

FIG. 2 is a representation of the thin film resistor 10 showing the various thicknesses of the "sandwich" layers. In a preferred embodiment insulating layer 14 is 2000 angstroms thick, resistor layer 16 is 100 angstroms thick, and passivation layer 18 is 4300 angstroms thick. It will be appreciated that these layer thicknesses may be varied depending on the particular specifications of the integrated circuit.

Next, turning to FIGS. 3-A through 3-I, a method of fabricating the "sandwich" structure thin film resistor in accordance with a preferred embodiment of the present invention is shown.

In FIG. 3-A, a semi-insulating GaAs substrate 12 is shown. On substrate 12, a SiN insulating layer 14 has been deposited by a process such as plasma enhanced chemical vapor deposition or any other suitable deposition process known to those skilled in the art. In addition, the GaAs substrate 12 of this preferred embodiment may be replaced with other appropriate substrates such as InP.

FIG. 3-B shows a resistor layer 16 which has been evaporated upon insulating layer 14 by electron beam evaporation. Other suitable standard evaporation or deposition processes known to those skilled in the art may also be used.

Next, FIG. 3-C shows a photoresist layer 22 which has been deposited, selectively developed, and dissolved on top of resistor layer 16 and insulating layer 14 using a standard photolithography procedure. The remaining areas of the thin film resistor not covered by photoresist layer 22 will become the contact surface areas for interconnect metal contacts 20 (FIC) of FIG. 3-D.

FIG. 3-D is a representation of thin film resistor 10 after a metal has been evaporated, as discussed above, over the entire thin film resistor structure. The first interconnect metal contacts (FIC) 20 are in physical contact with resistor layer 16 and insulating layer 14. Also an overlaying metal 24 has been placed on top of photoresist layer 22.

FIG. 3-E is a representation of thin film resistor 10 after photoresist layer 22 and overlaying metal 24 have been lifted off from the thin film resistor by a photoresist metal liftoff process well known to those skilled in the art.

Now turning to FIG. 3-F, it is shown that a passivation layer 18 of SiN has been deposited, according to the process discussed above, over the entire surface area of the thin film resistor structure 10. Passivation layer 18 forms the top layer of the "sandwich" structure according to the present invention.

FIG. 3-G shows a photoresist layer 26 which has been patterned upon passivation layer 18 such that areas of passivation layer 18 which overlay first interconnect metal contacts (FIC) 20 are exposed.

In FIG. 3-H, the areas of passivation layer 18 not covered by photoresist layer 26 have been etched away, by a common method known to those skilled in the art, providing access to first interconnect metal contacts (FIC) 20.

Finally, FIG. 3-I is a representation of the completed thin film resistor 10 after photoresist layer 26 has been stripped from passivation layer 18. This completed "sandwich" structure encloses resistor layer 16 such that the bottom surface of resistor layer 16 is in contact with insulating layer 14 and is not in contact with the substrate material as in the prior thin film resistors.

Figure 4:
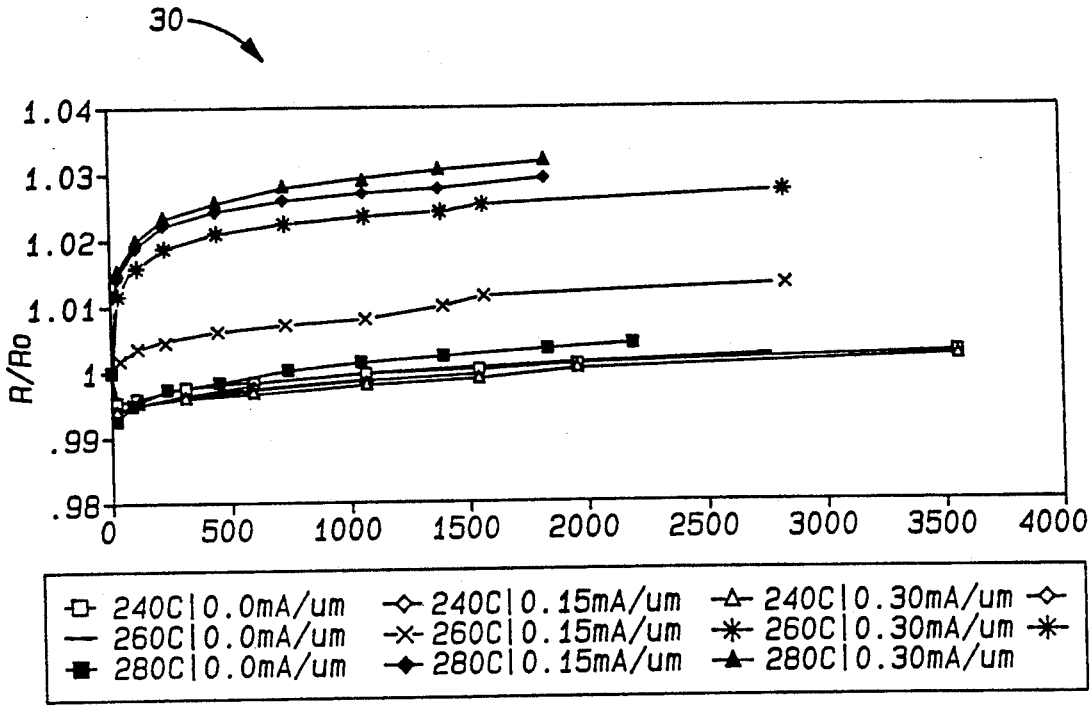
FIG. 4 shows the change in the ratio of the resistance after various periods of life testing to the initial resistance of the thin film resistor of the present invention.

Now turning to FIG. 4, there is shown a graph 30 depicting the results for the first2000 hours of life testing of thin film resistors produced in accordance with the techniques of the present invention. The life testing was conducted with 200 ohm (nominal) thin film resistors with sheet resistances of 100 ohms per square (Ω/□). The thin film resistors each measured 20 μm×40μm×100Å (width×length ×thickness). The failure criteria for the life test was when a thin film resistor had a change in resistance of greater than ±3.0%. A 50% failure of a test cell's population was considered a life test failure, but each cell was monitored until 75–80% of the cell's population failed the percentage criteria. Each data point in FIG. 4 represents the average change in resistance of each test cell ($R/R_o$;R= resistance at life test time; $R_o$=initial resistance). The standard deviation at each data small point is <0.005. The graph shows a maximum percent change of +3.1% in the worst cell case (280° C., 0.3mμm; Δ%=(1.031−1) / 1=+3.1%). Most changes in resistance occurred during the initial 75 hours of the life test for all cells, suggesting a presence of a heat induced annealing process. These test results show that the thin film resistor with insulating layer 14 is reliable for 2000 hours even when subjected to temperatures far in excess of the standard maximum military temperature of 125° C.

Figure 5:
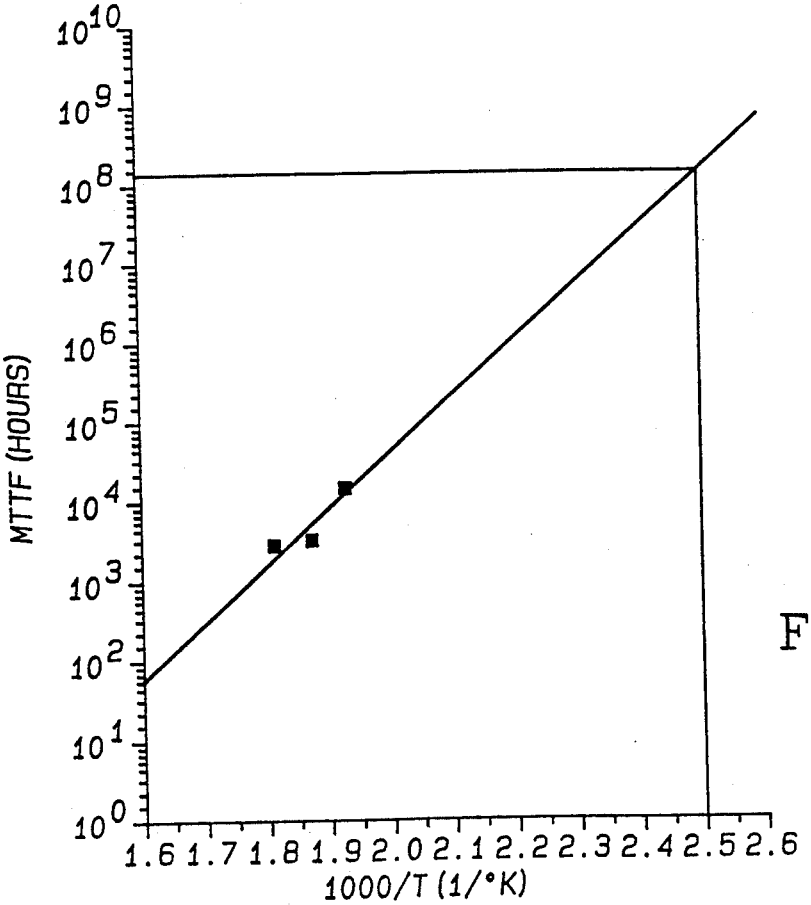
FIG. 5 shows the Arrhenius relationship between the mean time to failure and the operating temperature of the thin film resistor of the present invention.

FIG. 5 is an Arrhenius plot of the mean time to failure as a function of temperature for the thin film resistors of the present invention. This plot indicates the reliability of these thin film resistors when subjected to a current density of $3\times10^6 A/cm^2$ at standard maximum military temperature of 125° C. The data was obtained by linearly extrapolating the last three points of FIG. 4 using a failure criteria of ±3.0% deviation in resistance. The horizontal axis represents the resistor's surrounding temperature in units of 1000/°K, and the vertical axis represents the mean time to failure in hours. Assuming that the cell's population follows a log-normal behavior, the thin film resistor is estimated to have a mean time to failure of approximately $2\times10^8$ hours at 125° C. with an activation energy of 1.42 eV. From FIG. 5, it will be appreciated by those skilled in the art that the thin film resistor produced according to the present invention has a much longer mean time to failure than conventional thin film resistors, which typically have a mean time to failure of a few hundred hours.

FIG. 6 is a table comparing the required surface area of thin film resistors of the present invention (Case 1) and prior technology (Case 2). In each case the resistors have thicknesses of 100Å. The design conditions are a 200Ω resistor with resistivity of 100 ohm per square and current handling capability of 6.0 mA. The thin film resistor 10 with insulating layer 14 has a design capability of $3\times10^6$ A/cm$^2$ compared to $2\times10^5$ A/cm$^2$ for prior technology thin film resistors. As a result, the thin film resistor produced according to a preferred embodiment of this invention requires a surface area of only 800 $\mu m^2$ compared to $1.8\times10^5$ $\mu m^2$ for prior technology thin film resistors. This means that thin film resistor 10 of the present invention has a surface area requirement that is 225 times smaller than that of a thin film resistor produced according to prior technology military standards. It is apparent that thin film resistors with the "sandwich"structure require much less surface area of the integrated circuit chip on which it is produced. This permits a reduction in the cost of integrated circuits incorporating such resistors.

From the foregoing it can be seen that the use of the insulating layer displaced between the resistor layer and the substrate of the thin film resistor has several useful consequences. Compared to a thin film resistor with a resistor material evaporated directly upon the substrate, the mean time to failure is increased from a few hundred hours upwards to $2\times10^8$ hours at 125° C. with activation energy of 1.42 eV, the maximum current handling capability is increased by greater than one order of magnitude from $2\times10^5$ A/cm$^2$ to $3\times10^6$ A/cm$^2$, and the required surface area of the wafer is 225 times smaller. Of course, the teachings of the present invention can be employed to produce thin film resistors with variations in thicknesses of the insulating, passivation, and resistor layers. Also, various materials besides SiN, NiCr, and GaAs may be utilized to produce thin film resistors incorporating the insulating layer.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined by the following claims.

What is claimed is:

1. A thin film resistor for an integrated circuit comprising:

substrate means having a top surface;

insulating layer means formed on the top surface of said substrate means, said insulating layer means having a top surface;

resistor layer means formed on and in contact with the top surface of said insulating layer means opposite to the substrate means; and contact means for making electrical contact with said resistor layer means, whereby said insulating layer means between said substrate means and said resistor layer means prevents diffusion of said resistor layer means into said substrate means.

2. The thin film resistor of claim 1 further comprising a passivation layer means formed on top of said resistor layer means, whereby said passivation layer means passivates said resistor layer means.

3. The thin film resistor of claim 2 wherein said substrate means is composed of gallium arsenide.

4. The thin film resistor of claim 1 wherein said insulating layer means is composed of silicon nitride.

5. The thin film resistor of claim 1 wherein said resistor layer is composed of nichrome.

6. The thin film resistor of claim 1 wherein said insulating layer means is about 2000 angstroms thick.

7. The thin film resistor of claim 1 wherein said resistor layer means is about 100 angstroms thick.

8. An integrated circuit comprising:

integrated circuit substrate means having a top surface;

insulating layer means formed on the top surface of said integrated circuit substrate means, said insulating layer means having a top surface;

resistor layer means formed on and in contact with the top surface of said insulating layer means opposite to the substrate means; and contact means for making electrical contact with said resistor layer means, whereby said insulating layer means between said integrated circuit substrate means and said resistor layer means prevents diffusion of said resistor layer means into said integrated circuit substrate means.

9. The integrated circuit of claim 8 further comprising a passivation layer means formed on top of said resistor layer means, whereby said passivation layer means passivates said resistor layer means.

10. The integrated circuit of claim 8 wherein said substrate means is a gallium arsenide wafer.

11. The integrated circuit of claim 8 wherein said insulating layer means is composed of silicon nitride.

12. The integrated circuit of claim 8 wherein said resistor layer means is composed of nichrome.

13. The integrated circuit of claim 8 wherein said insulating layer means is about 2000 angstroms thick.

14. The integrated circuit of claim 8 wherein said resistor layer means is about 100 angstroms thick.

15. An integrated circuit comprising:

gallium arsenide integrated circuit substrate means having a top surface;

insulating layer means composed of silicon nitride and formed on said integrated circuit substrate means top surface, said insulating means having a top surface;

resistor layer means composed of nichrome and formed on top of said insulating layer opposite to the substrate means and in contact with the top surface of the insulating means;

passivation layer means composed of silicon nitride and formed on top of said resistor layers means, whereby said passivation layer means passivates said resistor layer means; and contact means for making electrical contact with said resistor layer means, whereby said insulating layer means between said integrated circuit substrate means and said resistor layer means prevents diffusion of said resistor layer means into said integrated circuit substrate means.

16. A method of producing a thin film resistor comprising the steps of:

providing a substrate wafer having a substantially flat top surface;

forming an insulating layer means on top of said flat top surface of said substrate wafer, said insulating layer means having a top surface;

forming a resistor layer means on top of said insulating layer means opposite to the substrate means an in contact with the top surface of the insulating means, whereby said insulating layer means prevents said resistor layer means from diffusing into said substrate wafer; and forming a contact means for making electrical contact with said resistor layer means.

17. The method of claim 16 wherein said step of forming said insulating layer means comprises the step of depositing silicon nitride onto said flat top surface of said substrate wafer.

18. The method of claim 17 wherein said step of forming said resistor layer means comprises the step of evaporating nichrome on top of said insulating layer means.

19. The method of claim 18 wherein said step of forming said contact means comprises the steps of:

depositing a first photoresist on said resistor layer means and said insulating layer means;

selectively developing said first photoresist into desirable geometric patterns by a photolithography process to form a desirable contact means profile pattern;

evaporating a metal on top of said first photoresist and said thin film resistor; and stripping said first photoresist and said metal evaporated on top of said first photoresist.

20. The method of claim 16 further comprising the steps of:

depositing a second photoresist on said passivation layer means;

selectively developing said second photoresist into desirable geometric patterns by a photolithography process such that areas of said passivation layer means overlaying said contact means are not covered by said second photoresist;

etching said passivation layer means not covered by said second photoresist; and stripping said second photoresist.

* * * * *